United States Patent [19]

Nelson

[11] Patent Number: 4,901,425

[45] Date of Patent: Feb. 20, 1990

[54] METHOD OF INSULATING A WATER HEATER DEVICE

[75] Inventor: Thomas E. Nelson, Anchorage, Ky.

[73] Assignee: Soltech, Inc., Shelbyville, Ky.

[21] Appl. No.: 330,296

[22] Filed: Mar. 29, 1989

Related U.S. Application Data

[62] Division of Ser. No. 177,393, Apr. 4, 1988, Pat. No. 4,844,049.

[51] Int. Cl.[4] ..... B21D 39/00; B23P 11/00

[52] U.S. Cl. ..... 29/455.1; 29/460

[58] Field of Search ..... 29/455.1, 460; 264/45.5, 46.9, 45.2; 126/344, 375, 376; 122/13 A; 219/312, 316

[56] References Cited

U.S. PATENT DOCUMENTS

| | | | |
|---|---|---|---|
| 1,604,980 | 11/1926 | Dominguez | 122/13 A UX |
| 2,386,949 | 10/1945 | Hayward | 122/13 A X |
| 2,456,143 | 12/1948 | Osterheld | 219/316 |
| 2,544,927 | 3/1951 | Knapp | 122/13 A |
| 2,809,267 | 10/1957 | Schaver, Jr. | 219/312 X |
| 4,372,028 | 2/1983 | Clark et al. | 29/460 |
| 4,436,058 | 3/1984 | McAlister | 122/13 A X |
| 4,447,377 | 5/1984 | Denton | 264/46.9 X |
| 4,477,399 | 10/1984 | Tilton | 264/46.9 X |
| 4,531,572 | 7/1985 | Molitor | 219/312 X |
| 4,749,532 | 6/1988 | Pfeffer | 264/46.5 |

*Primary Examiner*—Charlie T. Moon

*Attorney, Agent, or Firm*—Woodard, Emhardt, Naughton, Moriarty & McNett

[57] ABSTRACT

A water heater device including an inner tank for containing water surrounded in spaced apart relationship by an outer shell. The top end of the water heater device is closed by a cap, and the bottom end of the water heater construction is closed by a floor connected to the outer shell. The inner tank has a concave bottom wall. A collar of thermal insulation material, such as fiber glass is located in the annular space between the inner tank and outer sleeve proximate the bottom end of the water heater device concentric with the annular space such that the collar is in contact with the interior wall surface of the outer shell, in contact with the exterior wall surface of the inner tank, and in contact with the floor of the water heater device. The collar has a radial thickness greater than the radial width of the annular space such that the collar is compressed between the interior wall surface of the outer shell and exterior wall surface of the inner tank sufficiently to tightly seal the interface of the collar and inner wall surface of the outer sleeve, and seal the interface of the collar and exterior wall surface of the inner tank. A disc of thermal insulation material, such as fiber glass, is located within the concavity of the bottom wall of the inner tank. Further, the annular space above the annular collar is filled with an expandable foam thermal insulation material.

1 Claim, 2 Drawing Sheets

METHOD OF INSULATING A WATER HEATER DEVICE

This application is a division, of application Ser. No. 177,393, filed 4/4/88 now U.S. Pat. No. 4,844,049.

BACKGROUND OF THE INVENTION

The present invention relates to water heater devices and more particularly to a thermally insulated water heater device.

It is becoming more important to improve the insulation of hot water heaters to conserve energy.

Typically, water heater devices are constructed of an inner water tank with an outer shell located concentrically over the inner tank defining an annular space therebetween, a cap closing the top end of the water heater device, and a floor closing the bottom end of the water heater device. The space between the inner tank and outer shell is filled with a thermal insulation. For many years fiber glass mats have been used as the insulation material between the inner tank and outer shell. More recently a foam, such as urethane, has been used as the thermal insulation material in place of fiber glass between the inner tank and outer shell. Typically, a foamable material is injected into the annular space between the inner tank and outer shell, and is allowed to foam in situ. However, there is a problem in restraining the expanding foam within the annual space and more particularly within a predetermined location or region within the annular space. Further, it is a problem during manufacture of the water heater device to insulate the bottom end of the water tank.

Various proposals have been made to solve this problem.

U.S. Pat. No. 4,372,028 issued on Feb. 8, 1983 shows a water heater having a foam filled closed bag located in the annular space between the inner tank and outer shell at the bottom of the inner tank, with the annular space above the annular bag filled with expanded foam. The collar functions as a stop to the expanded foam in the annular space thereabove. In the manufacture of the water heater a flexible, expandable closed elongated bag having a hole therein is filled with a foam material which expands the bag, and before the foam material has had sufficient time to fully expand, the bag opening is sealed and the bag is circumferentially wrapped around the lower end of the tank with the bag ends overlapping each other. Still, before the foam material in the bag has had sufficient time to expand, the outer shell is positioned over the inner tank and bag. The foam in the bag expands to be in compression between the inner tank and outer shell. The annular space above the collar is then filled with expandable foam material.

U.S. Pat. No. 4,447,377 issued on May 8, 1977 shows a gas fired water heater wherein a layer of fiber glass batt insulation material is wrapped around the bottom portion of the inner water tank around the combustion chamber and a plastic envelope is wrapped around the inner tank above the fiber glass insulation. The envelope is in the form of an elongated thin tube having an inner wall, an outer wall, a bottom wall, two end walls and an open top. When wrapped around the inner tank, the end walls of the envelope abut each other. The outer shell is positioned over the inner tank such that the envelope is in the annular space therebetween. Expandable foam is injected through the open envelope top into the envelope and allowed to expand therein. The fiber glass batt does not form a seal between itself and the inner water tank and the outer shell.

U.S. Pat. No. 4,477,399 issued on Oct. 16, 1984 shows a water heater having an inflatable toroidally shaped tube located around the bottom end of the inner tank such that when the toroidal tube is inflated with air, it seals the bottom end of the annular space between the inner tank and outer shell. A formable material is then injected into the annular space above the toroidal tube to fill the annular space.

It is also known to position a layer of insulation, batting, such as a layer of fiber glass batt, over the bottom end of the water tank.

Each of the above discussed known water heater constructions present numerous problems in manufacture such as, for example, a large number of steps, critically timed steps, and time consuming steps which add to the cost and present potential for defects in the final product.

SUMMARY OF THE INVENTION

The present invention provides a water heater construction which overcomes these drawbacks in a straightforward manner.

The present invention provides a water heater device comprising an inner water tank, an outer shell concentrically located over the inner water tank defining an annular space therebetween, a collar of insulation material enclosed in an envelope located in the annular space proximate the bottom end of the water heater device circumscribing the inner water tank, the collar having a radial thickness greater than the radial width of the annular space such that the collar is radially compressed between the inner water tank and outer shell creating a seal at the interface of the inner surface of the outer shell and the collar and a seal at the interface of the outer surface of the inner water tank and the collar, a disc of insulation material enclosed in an envelope configured and sized to cover the bottom end of the inner water tank overlaying the bottom end of the water tank, and expanded insulation foam material filling the annular space between the inner water tank and outer shell above the collar.

BRIEF DESCRIPTION OF THE DRAWING

A better understanding of the present invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
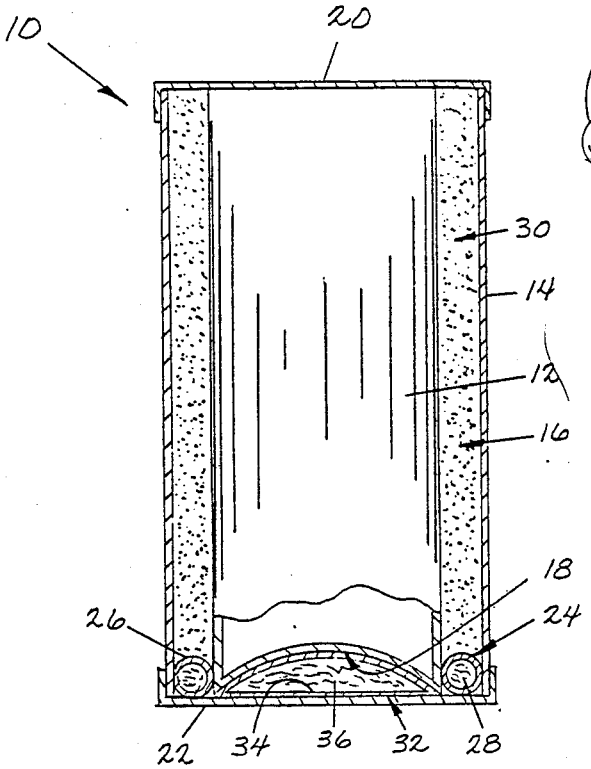
FIG. 1 is a longitudinal cross-sectional view of a water heater device including the present invention.

FIG. 1 schematically illustrates, in longitudinal cross-section, a water heater device, generally denoted as the numeral 10, having a generally cylindrical inner water tank 12 for containing water and a generally cylindrical outer shell 14 concentrically surrounding the inner water tank 12. The outer shell 14 is of a larger diameter than the water tank 12 and they cooperate to define an annular space 16 therebetween. As illustrated, the water heater device 10 is of the electrically heated type having, for example, an electrical resistance unit (not shown) projecting into the interior of the water tank 12 to heat the water therein. The bottom end of the inner water tank 12 is formed with a concavity 18. The top end of the water heater device 12 is closed by a cap 20, which may be a separate component or may be unitary with the outer shell 14. The bottom end of the water heater device 10 is typically closed by a floor member or bottom cap 22.

Figure 5:
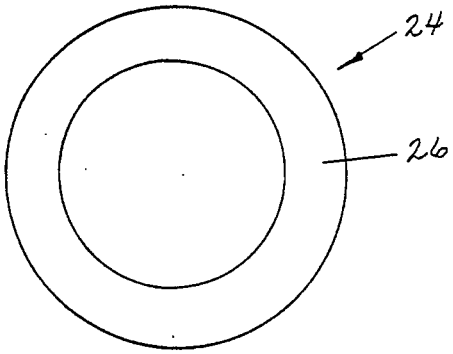
FIG. 5 illustrates an alternative embodiment of the component of FIG. 2.

With reference to FIGS. 1 and 5, an insulating thermal collar 24 is located in the annular space 16. The collar 24 includes an enclosing envelope 26 filled with a thermal insulating material 28. The enclosing envelope 26 is fabricated of a fluid impermeable, pliable material such as, for example, polyethylene film, vinyl film, metalized polyester, metal foil, and the like. The thermal insulation material 28 can be a fibrous batt, such as interwoven fiberglass, or a loose, discrete, divided material, such as for example non-interengaged fiber glass, mineral wool, steel wool, cellulose, ceramic fiber, discrete particles or beads of plastic foam, and the like. It is contemplated, that in some applications, it may be necessary to cohesively hold the loose, discrete, divided insulation material together inside the envelope 26 to prevent the insulation material from shifting or settling within the enclosing envelope 26. In this event, a binder material is homogeneously dispersed throughout the mass of the insulation material 28 to cohesively hold the insulation material together, and possibly adhesively affix the insulation material to the wall of the envelope 26, to prevent the insulation material 28 from shifting or settling within the envelope 26. The binding material used is a function of the type of insulation material 28 and can be a thermosetting adhesive, thermoplastic adhesive, cold setting adhesive, ambient setting adhesive, or hot setting adhesive. For example, a suitable adhesive for use with fiber glass and mineral wool is phenolic or sodium silicate, and a suitable adhesive for cellulose is polyvinyl acetate.

The collar 24 extends circumferentially around the inner water tank 12 in the annular space 16 proximate the bottom end of the water heater device 10. The collar 24 has a width greater than the radial width of the annular space 16 so that the collar 24 is radially compressed between the interior wall surface of the outer shell 14 and the exterior wall surface of the inner water tank 12 sufficiently to tightly seal the interface of the collar 24 and inner wall surface of the outer shell 14 and to tightly seal the interface of the collar 24 and exterior wall surface of the inner water tank 12. In addition, the collar 24 is in abutment with the water heater device bottom cap 22.

Figure 2:
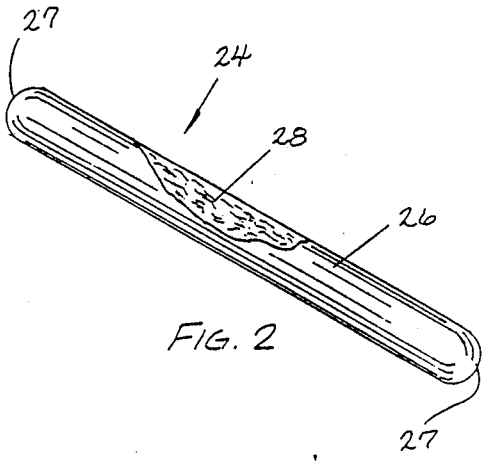
FIG. 2 is a perspective view of a component of the present invention with portions broken away to show internal details.

With reference to FIGS. 2 and 5, the enclosing envelope 26 of the collar 24 is in the form of an elongated generally cylindrical tube closed at both of its ends 27 and 29. The tubular collar 24 is circumferentially wrapped around the perimeter of the water tank 12 with the ends 27 and 29 thereof brought together into mutual abutment. The abutting ends 27 and 29 can be secured together by, for example, adhesive tape if necessary.

Figure 3:
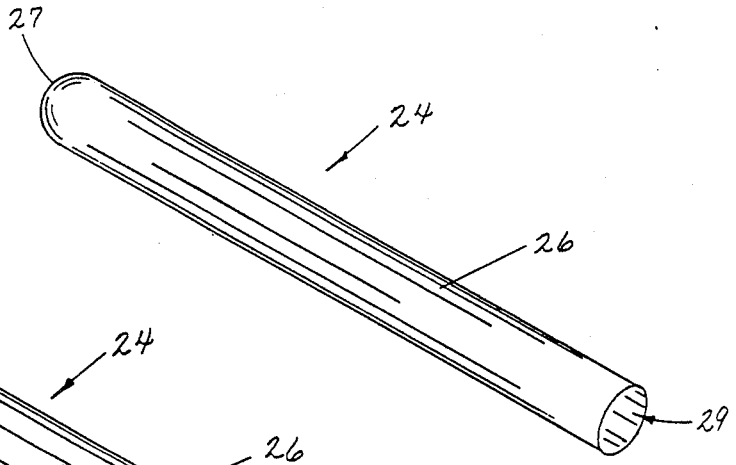
FIG. 3 illustrates an alternative embodiment of the component of FIG. 2.

With reference to FIG. 3, the enclosing envelope 26 of the collar 24 is in the form of an elongated generally cylindrical tube having one of its ends 27 closed and the other of its ends 29 open. The tubular collar 24 is circumferentially wrapped around the perimeter of the water tank 12 and the closed end 27 is inserted into the open end 29. The ends 27 and 29 can be secured together by, for example, adhesive tape, if necessary.

Figure 4:
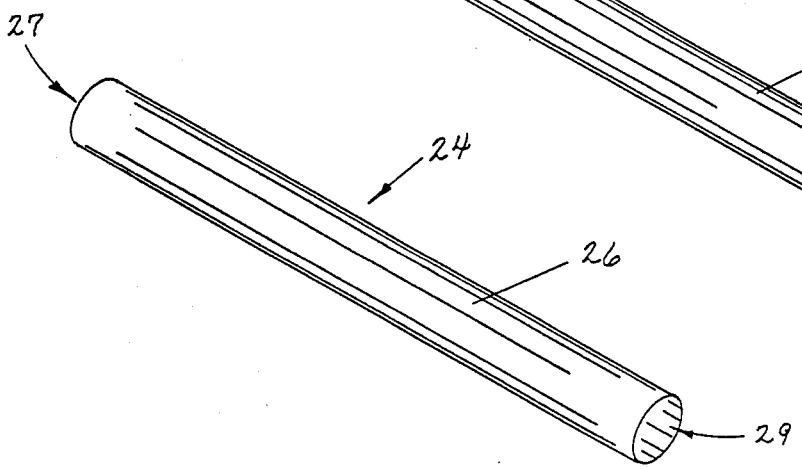
FIG. 4 illustrates an alternative embodiment of the component of FIG. 2.

With reference to FIG. 4, the enclosing envelope 26 of the collar 24 is in the form of an elongated generally cylindrical tube having both of its ends 27 and 29 open. The tubular collar 24 is circumferentially wrapped around the perimeter of the water tank 12 and one of the open ends 27 is inserted into the other of the open ends 29. The ends 27 and 29 can be secured together by, for example, adhesive tape, if necessary.

With reference to FIG. 5, the enclosing envelope 26 of the collar 24 is in the form of a closed toroid. The toroid collar 24 is concentrically slid over the water tank 12.

With reference once again to FIG. 1, the annular space 16 above the collar 24 is filled with an expanded foam thermal insulation material 30 such as urethane, polyethylene, polystyrene and the like, which functions as a thermal insulation surrounding the inner water tank 12.

Figure 6:
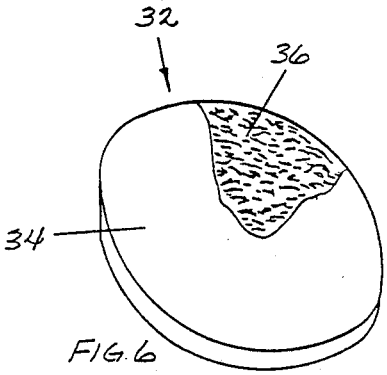
FIG. 6 is a perspective view of another component of the present invention with portions broken away to show internal details.

With reference to FIGS. 1 and 6, an insulating disc 32 is located at the bottom end of the inner water tank 12. The insulating disc 32 includes an enclosing envelope 34 filled with a thermal insulation material 36. The enclosing envelope 34 has a peripheral configuration matching that of the bottom end of the water heater 12 and a thickness preferably at least as great as the depth of the concavity 18. As shown, the envelope 34 has a generally circular perimeter to correspond to the perimeter of the bottom end of the inner water tank 12 so that the disc 34 overlays the bottom end of the tank. The enclosing envelope 34 is fabricated of a fluid impermeable, pliable material such as, for example, polyethylene film, vinyl film, metalized polyester, metal foil, and the like. The thermal insulation material 36 is either a fibrous batt such as interwoven fiberglass, or a loose, discrete, divided material such as, for example, non-interengaged fiber glass, steel wool, mineral wool, cellulose fibers, ceramic fibers, discrete particles or beads of plastic foam, and the like. It is contemplated that in some applications it may be necessary to cohesively hold the loose, discrete, divided insulation material together inside the envelope 34, and possibly adhesively affix the insulation material to the wall of the envelope 34, to prevent the insulation material from shifting or settling within the enclosing envelope 34. In this event, a binder material is homogeneously dispersed throughout the mass of insulation material 36 to cohesively hold the insulation material together and prevent the insulation material from shifting or settling within the envelope 34. The binder material used will be a function of the type of insulation material 36 and can be a thermosetting adhesive, thermoplastic adhesive, cold setting adhesive, ambient setting adhesive, or hot setting adhesive. For example, a suitable adhesive for use with fiber glass and mineral wool is phenolic or sodium silicate, and a suitable adhesive for cellulose is polyvinyl acetate.

Figure 7:
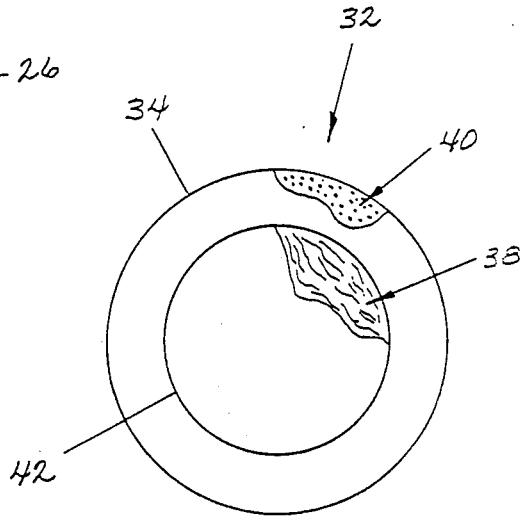
FIG. 7 illustrates an alternative embodiment of the component of FIG. 6.

With reference to FIG. 7, the insulating disc 32 includes an enclosing envelope 34 having a peripheral configuration generally matching that of the bottom end of the water tank and a thickness preferably at least as great as the depth of the cavity 18. The envelope 34 includes a central inner circular pocket 38 concentrically surrounded by a perimeter outer pocket 40. The envelope 34 is fabricated of a fluid impermeable, pliable material such as, for example, polyethylene film, vinyl film, metalized polyester, metal foil and the like. The central circular pocket 38 is separated from the perimeter pocket 40 by a circular seal 42. The central circular pocket 38 is filled with a fibrous batt of insulation material, such as interwoven or interengaged fiberglass, and the perimeter pocket 40 is filled with a loose, discrete, divided insulation material such as, for example, non-interengaged fiber glass, mineral wool, steel wool, cellulose fibers, ceramic fibers, discrete particles of beads of plastic foam, and the like. However, it is contemplated that the central circular packet 38 be filled with the loose, discrete, divided insulation material and the perimeter pocket 40 be filled with the fibrous batt. It is contemplated that in some applications, it may be necessary to cohesively hold the loose, discrete, divided insulation together inside of the pocket. In this event, a binder material is homogeneously dispersed throughout the mass of insulation material within the pocket to cohesively hold the insulation material together, and possibly adhesively affix the insulation material to the wall of the pocket to prevent the insulation material from shifting or settling within the pocket. The binder material used will be a function of the type of insulation material used within the pocket and can be thermosetting adhesive, thermoplastic adhesive, cold setting adhesive, ambient setting adhesive, or hot setting adhesive. For example, a suitable adhesive for use with fiber glass and mineral wool is phenolic or sodium silicate, and a suitable adhesive for cellulose is polyvinyl acetate.

Figure 8:
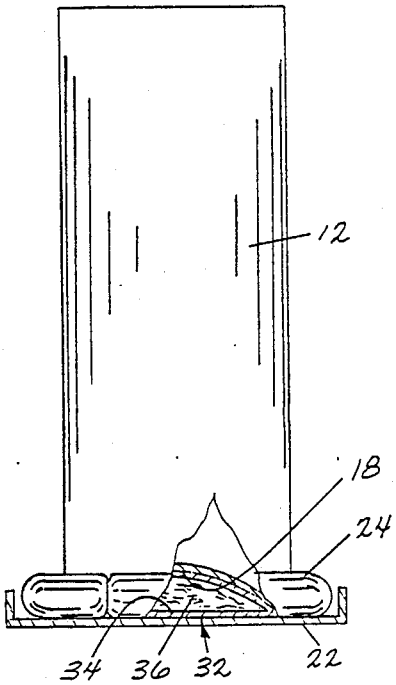
FIG. 8 is a schematic representation illustrating steps of the manufacture of the water heater device of FIG. 1.
Figure 9:
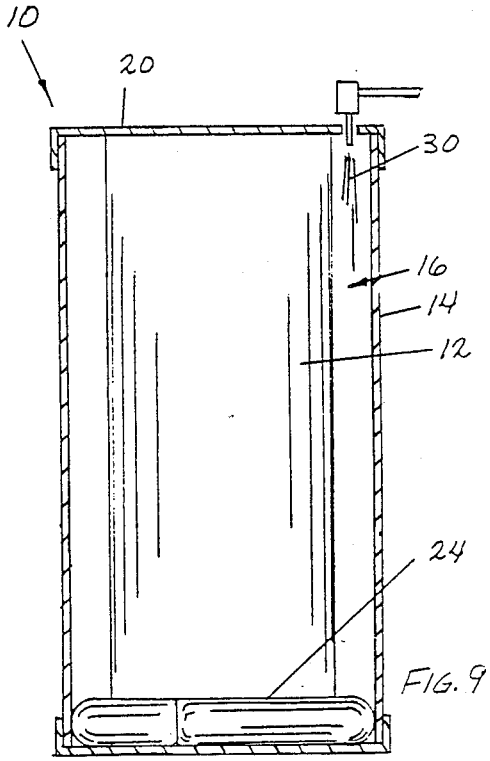
FIG. 9 is a schematic representation illustrating further steps of the manufacture of the water heater device of FIG. 1.

With reference to FIGS. 8 and 9, there is illustrated, in schematic format, the results of various steps for manufacturing the water heater 10. The insulation collar 24 is circumferentially fitted around the perimeter of the inner water tank 12 proximate the bottom end thereof. The collar 24 can be secured to the wall of the water tank 12 by an adhesive, or tape. The insulating disc 32 is disposed in overlaying relationship to the bottom end of the ater tank 12, and can be secured in place by an adhesive or a tape. The outer shell 14 is coaxially moved over the inner water tank 12, the floor 22 is positioned over the bottom of the water tank 12 and the outer shell 14 assembly to close the bottom of the water heater device 10. An expandable foam insulation material 30 is injected into the annular space 16 between the inner water tank 12 and the outer shell 14 above the collar 24 and allowed to expand in situ filling the annular space 16 above the collar 24. The collar 24 is radially compressed between the inner wall surface of the outer shell 14 and the outer wall surface of the inner water tank 12 to form a seal at the interface of the collar 24 and outer shell 14 and a seal at the interface of the collar 24 and inner water tank 12, and functions as a stop or block to the expanding foam.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A method of insulating a water heater device of the type including an inner water tank with a generally cylindrical side wall and a contoured bottom surface, an outer shell surrounding and radially spaced from the inner water tank so as to define a first clearance space therebetween and a bottom cap disposed beneath the bottom surface of the water tank so as to define a second clearance space therebetween, the method comprising the following steps:

providing a collar of insulation material with a size and shape configuration to radially seal said first clearance space between said inner water tank and said outer shell;

providing an enclosed envelope with insulation material contained therein having a size and shape configuration to fit within said second clearance space;

attaching said collar to the side wall proximate the bottom of the inner water tank and said envelope to the bottom surface of said water heater;

positioning the inner water tank on said bottom cap and within said outer shell; and injecting expandable foam insulation material into the first clearance space above said collar.

* * * * *